US009976742B1

(12) United States Patent
Olver

(10) Patent No.: US 9,976,742 B1
(45) Date of Patent: May 22, 2018

(54) CREMATORY

(71) Applicant: EMISSHIELD, Inc., Blacksburg, VA (US)

(72) Inventor: John W. Olver, Blacksburg, VA (US)

(73) Assignee: Emisshield, Inc., Blacksburg, VA (US)

( * ) Notice: Subject to any disclaimer, the term of this patent is extended or adjusted under 35 U.S.C. 154(b) by 681 days.

(21) Appl. No.: 14/320,432

(22) Filed: Jun. 30, 2014

Related U.S. Application Data

(60) Provisional application No. 61/841,414, filed on Jun. 30, 2013.

(51) Int. Cl.
*F23G 1/00* (2006.01)

(52) U.S. Cl.
CPC ..... *F23G 1/00* (2013.01); *F23G 2900/7009* (2013.01)

(58) Field of Classification Search
CPC ..... F23G 1/00
USPC ..... 427/376.2
See application file for complete search history.

(56) References Cited

U.S. PATENT DOCUMENTS

| | | | | |
|---|---|---|---|---|
| 1,742,868 | A | 9/1926 | Mann | |
| 3,874,310 | A | 4/1975 | Falling | |
| 4,321,878 | A * | 3/1982 | Segrest | F23G 1/00 110/194 |
| 4,685,403 | A | 8/1987 | Crawford | |
| 5,095,826 | A * | 3/1992 | Erisson | F23G 5/165 110/212 |
| 5,296,288 | A | 3/1994 | Kourtides | |
| 6,474,251 | B1 | 11/2002 | Vidallet | |
| 6,921,431 | B2 | 7/2005 | Evans | |
| 7,105,047 | B2 | 9/2006 | Simmons | |
| 2009/0252660 | A1 * | 10/2009 | Olver | C10G 9/20 422/600 |
| 2009/0293786 | A1 * | 12/2009 | Olver | C04B 35/03 110/336 |

* cited by examiner

*Primary Examiner* — David J Laux
(74) *Attorney, Agent, or Firm* — Johnston Holroyd; Mary-Jacq Holroyd

(57) ABSTRACT

A crematory, or crematory accessory, having a nano-emissive thermal enhancement layer disposed therein to generate even heat throughout the crematory heating chamber. A method of making a crematory or crematory accessory involves spraying an hydrous coating containing high emissivity constituents in an admixture on an exposed or unexposed a crematory refractory surface, or crematory accessory, or in a layer therein.

10 Claims, 4 Drawing Sheets

CREMATORY

RELATED APPLICATIONS

This application claims the benefit of U.S. Provisional Application Ser. No. 61/197,849 entitled "Crematory" filed on 30 Jun. 2013, the contents of which are incorporated herein by reference in its entirety.

COPYRIGHT NOTICE

A portion of the disclosure of this patent document may contain material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

Crematories are known facilities designed to incinerate or cremate human and animal remains. Conventional crematory have a main crematory chamber with a loading door to load human or animal remains into the main crematory chamber which is heated by a hearth that generates and maintains sufficiently elevated temperatures to cremate human remains placed within the main crematory chamber. Conventional crematories contain both refractory surfaces and metal surfaces. The walls and ceiling (also known as a "crown") composed of refractory bricks or the like. The remains are incinerated on a metal floor with or without an accessory container to capture the ashes. A stream of air is provided within the main crematory chamber to insure combustion.

Examples of traditional crematories involve the following examples. U.S. Pat. No. 1,742,868 teaches a crematory which has as an object to provide a furnace which can be charged with the remains to be cremated through one wall in the presence of the observers, after which the chagrining opening is closed. All operating process are located in and associated with another wall to hide the operation from onlookers. U.S. Pat. No. 3,874,310 teaches a crematory oven which consists of brickwork built up within and held together by a steel structure which includes end walls provided with doors and a steel floor. The oven is gas or oil fired and combustion supporting air is introduced through various ducts to ensure complete incineration of the coffin and body.

An unfortunate drawback of conventional crematoriums is that some remains are not fully consumed. Incomplete incineration results in mixed partially cremated remains and ashes. Furthermore, ash and soot build up on the interior surfaces of the crematorium resulting in uneven heat, and incomplete cremation. Various efforts to improve the completeness of incineration have been attempted. These efforts may result in elevated costs due to the time/fuel required for the most complete incineration possible, while others result in mixing partially incinerated remains together for further incineration.

Additional chambers for incineration of partially incinerated remains are provided in some designs. U.S. Pat. No. 4,321,878 teaches a secondary hearth crematory which has a primary cremation chamber and a second cremation chamber adjacent to and in communication with the first chamber so that the remains are partially incinerated in the first chamber, and then incinerated further in the second chamber (along with other remains) while new remains are in the first chamber. This feature was considered desirable to address a long standing problem with incomplete cremation due to the difficulty in maintaining a proper temperature range across an entire cremation chamber.

Similarly, U.S. Pat. No. 4,685,403 covers an auxiliary incinerator apparatus which has primary and secondary chambers formed with refractory walls and a main door into the primary chamber in which an auxiliary incinerator apparatus is attached to provide another incinerator chamber for partially incinerated material so that the partially incinerated material may be moved to the auxiliary chamber for further incineration.

Other efforts attempt to improve combustion. U.S. Pat. No. 6,474,251, for example, teaches a cremating method and cremator which uses an apparatus to create turbulence in the injecting air necessary for combustion in order to increase the efficiency of the cremation.

Regrettably, even with these efforts, not all of the remains are completely cremated leaving a need for more efficient crematory apparatus. Adversely, it is desirable to reduce the time of cremation and the energy usage to operate crematory units. It is desirable to increase efficiency of cremation by decreasing the costs while simultaneously limiting partially incinerated remains.

SUMMARY OF THE INVENTION

The present invention is an improved crematory and method of making the improved crematory from either an old crematory or during manufacturing of a new crematory which entails the application of a coating to form a nano-emissive thermal enhancement layer on at least a surface within the crematory. Specifically, a nano-emissive thermal enhancement layer may be applied to a ceramic or refractory surface within a chamber of a crematory to produce a substantially uniform thermal hue within that chamber and within adjacent chambers thereto.

Alternatively, or additionally, the metal floor or metal accessories used within the crematory may be coated with an alternative nano-emissive thermal enhancement layer instead of, or in addition to, the coating directly on the refractory or metal surfaces of the crematory. In other words, a second nano-emissive thermal enhancement layer may be provided on the floor or on metal accessories used within the crematory.

The uniform thermal hue created by the nano-emissive thermal enhancement layer provides uniformity within a 360° radius of the nano-emissive thermal enhancement layer including through any substrate. This benefit operates across surfaces so that the thermal enhancement layer may be applied on the other side of a surface for similar benefits. An analogy using the visible spectrum would be that a coloring applied to a piece of glass may be applied to either side of the glass to obtain a change in the visible spectral hue of the light passing through or reflecting off the surface of the piece of glass.

An advantage of the present design is demonstrated by a substantially uniform thermal hue present across the entire cremation chamber directly exposed to heat, or across substantially uniform gradients through the exhausting air flow, providing an essentially even temperature range across the main crematory chamber so that the target temperature range may be obtained and maintained for the cremation to be completed evenly across the remains. As the exhaust is removed, the nano-emissive thermal enhancement layer provides an even thermal paradigm as the exhaust cools while circulating through the afterburner chamber.

An objective of the present design is to reduce the time of the burn, cost of energy, and pollution emissions related to crematory usage. To that end, the improved crematory reduces the time and input temperatures required to reduce the costs of operation significantly.

It is also an objective to increase the number of times a single crematory may be used in a day. The present design permits the cremation of more bodies in a shorter period of time using less fuel.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1:
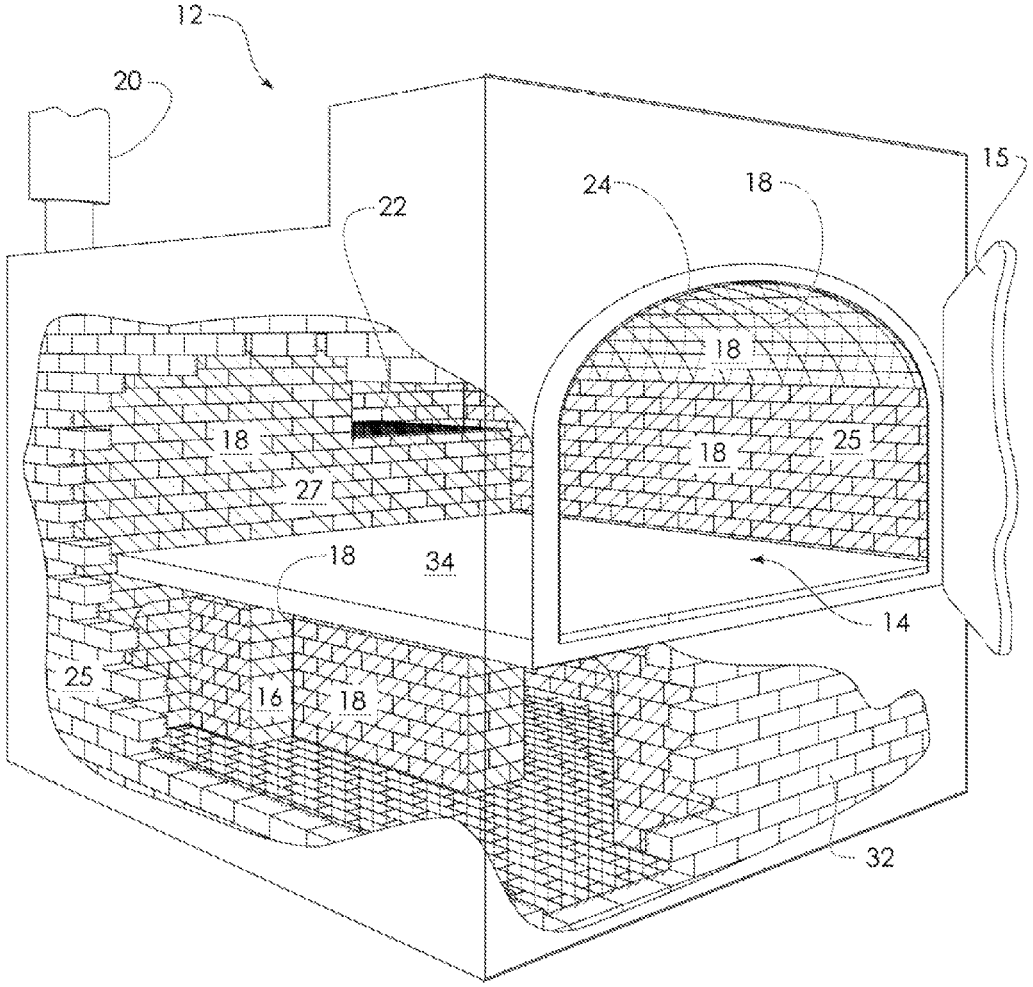
FIG. 1 shows a crematory according to the present design with a nano-emissive thermal enhancement layer disposed on surfaces therein.
Figure 2:
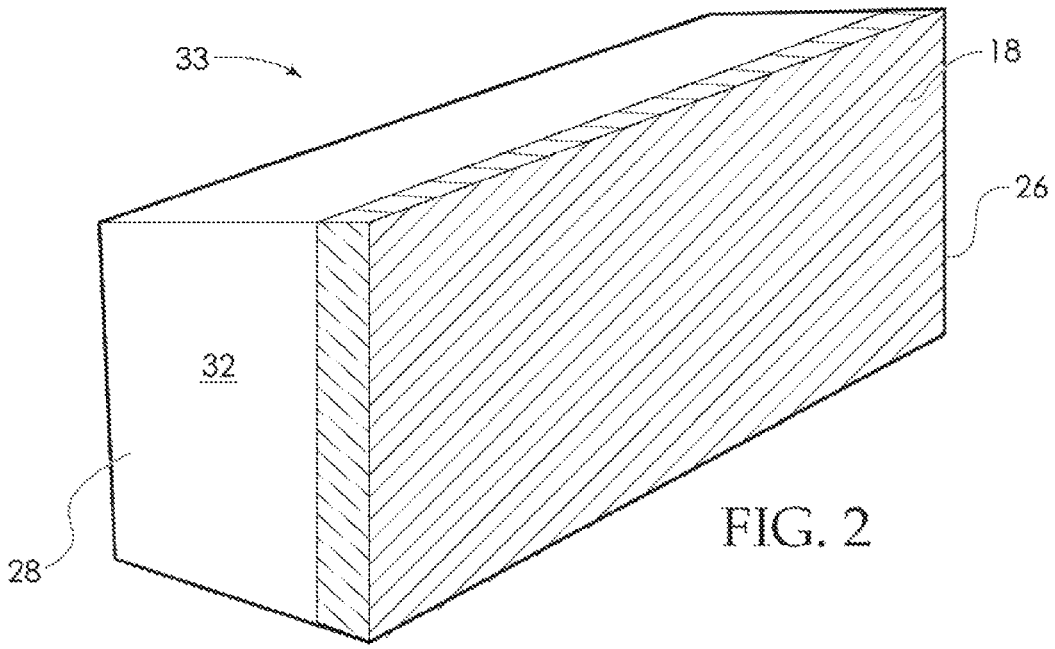
FIG. 2 shows part of a crematory showing the nano-emissive thermal enhancement layer disposed on a surface exposed directly to heat.
Figure 3:
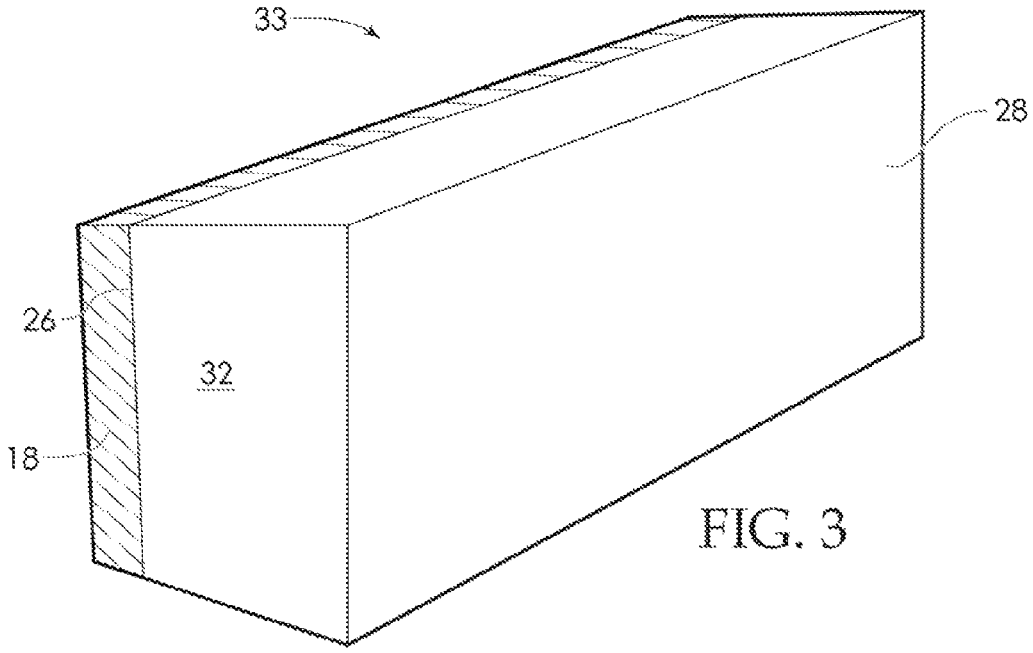
FIG. 3 shows part of a crematory showing the nano-emissive thermal enhancement layer on a surface that is not directly exposed to heat, such as a refractory brick, or the chamber within which, the remains are cremated.

The present design is an improved crematory 12 with a nano-emissive thermal enhancement layer 18 disposed therein, see FIG. 1, having a main crematory chamber 14, a refractory after burner chamber 16, a cap 24, a door 15 to insert remains into the main crematory chamber 14, and an exhaust or smoke stack 20. The heating system or hearth 22 is composed of burners, either gas, oil, or electric, which are used to heat the main crematory chamber 14 where the remains are placed. Refractory material 32, such as refractory brick 33, sheets (not shown) or other, are disposed within the crematory 12, and at least partially coated with a nano-emissivity thermal enhancement coating to form a layer 18 on an exposed surface 26, shown in FIG. 2, or on an unexposed surface 28, shown in FIG. 3.

In greater detail, the crematory 12 consisting of a main crematory chamber 14 with a loading door 15 to load human remains into the main crematory chamber 14 which is heated by a hearth 22 that generates and maintains sufficiently elevated temperatures to cremate human remains placed within the main crematory chamber 14. The crematory chamber 14 has crematory walls 25 and 27, including two opposing side walls 25, and a back wall 27 disposed opposite the door 15. The two opposing side walls 25 are long enough to accommodate human remains. The space between the back wall 27 and opposing door 15 is sufficiently wide to accommodate human remains. A crown 24 is disposed at the top of the walls 25 and 27 above a cremation chamber floor 34, with the cremation chamber floor 34 being disposed beneath the crown 24 with sufficient height (or space) to accommodate human remains therebetween.

The crematory walls 25 and 27 and crown 24 are at least partially composed of refractory material 32 forming a refractory surface 26 or 28. A nano-emissive thermal enhancement layer 18 is disposed at least partially on a refractory surface 26 or 28 within the main crematory chamber 14 to modulate the thermal hue therein to optimize the temperature for complete combustion of the remains. An after burner chamber 16 for cooling and evacuation of exhaust from the main crematory chamber 14 to the smoke stack 20. The after burner chamber 16 has a nano-emissive thermal enhancement layer disposed at least partially on refractory material 32 therein. Suitable compositions used to form the nano-emissive thermal enhancement layer are available from Emisshield, Inc. of Blacksburg, Va., and are sold under the trademark EMISSHIELD® and the trade name CREMKOTE™.

The nano-emissive thermal enhancement layer 18, which adheres to the surfaces of refractory material 32, comprises from about 5% to about 60% of colloidal silica, colloidal alumina, or combinations thereof, from about 23% to about 79% of a filler, and from about 1% to about 25% of one or more emissivity agents. A second nano-emissive thermal enhancement layer 18, may be disposed on metal surfaces, and comprises from about 5% to about 40% of an inorganic adhesive, from about 45% to about 92% of a filler, and from about 1% to about 25% of one or more emissivity agents.

Figure 4:
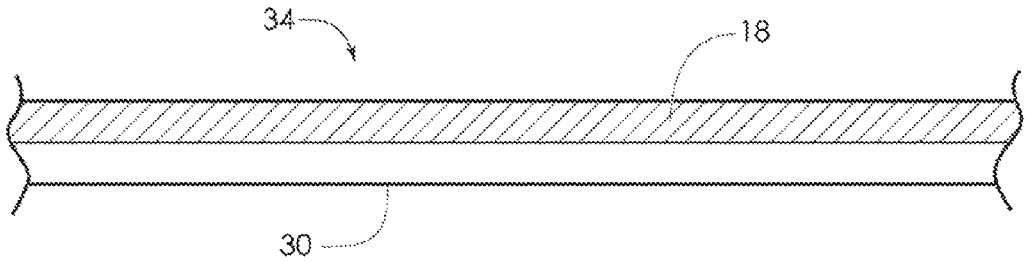
FIG. 4 shows a cutaway of a crematory accessory, such as a tray or floor, with a nano-emissive thermal enhancement layer on the top.
Figure 5:
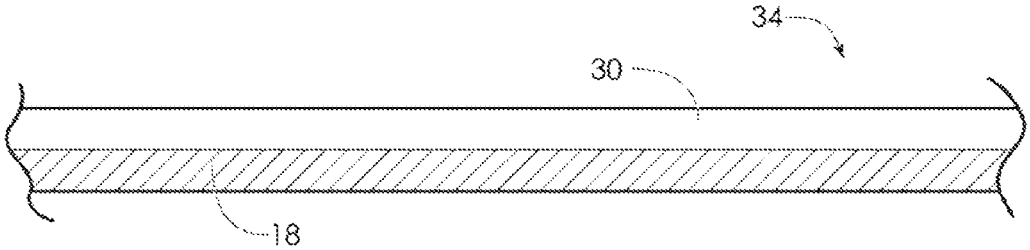
FIG. 5 shows a cutaway of a crematory accessory, such as a tray or floor, with a nano-emissive thermal enhancement layer on the bottom.
Figure 6:
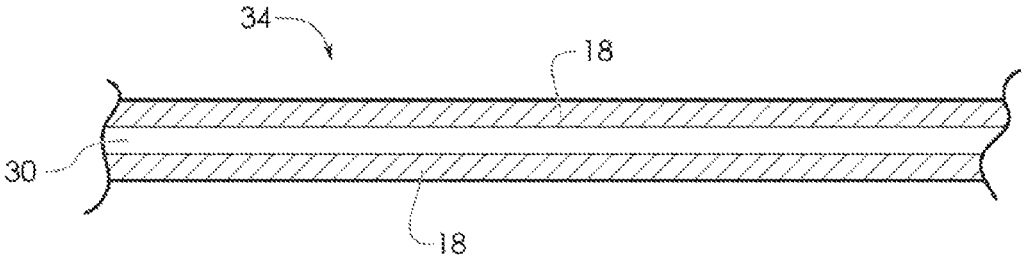
FIG. 6 shows a cutaway of a crematory accessory, such as a tray or floor, with nano-emissive thermal enhancement layer on the top and bottom.

In alternative embodiments of the present design, accessories 30 such as a tray 22, or floor 34, upon which the remains are placed may also be coated with a nano-emissive thermal enhancement layer 18 on the inside as in FIG. 4, the outside as in FIG. 5, both inside and outside as in FIG. 6, and as a layer 18 disposed within the accessory but not exposed. Metal floors 34 may be fixed or removable depending on the design of the crematory 12.

Figure 7:
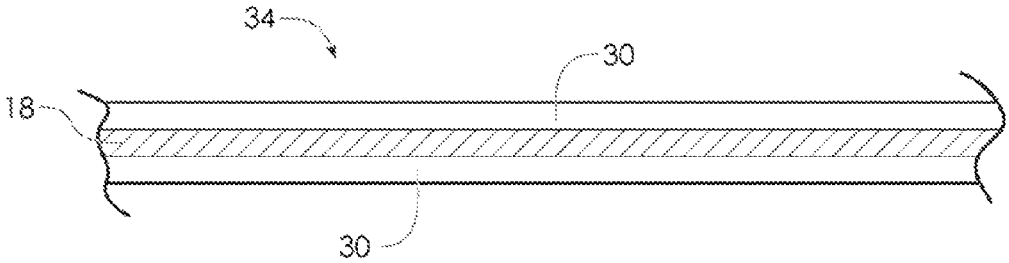
FIG. 7 shows a cutaway of a crematory accessory, such as a tray or floor, with a nano-emissive thermal enhancement layer disposed between opposing accessory parts.

These crematory accessories 34 include any devices whether composed of metal or not disposed within the chamber while in use, and is not limited to a tray or floor upon which the remains are placed. FIG. 7 shows a cutaway of a crematory accessory 34, such as a hearth, with a nano-emissive thermal enhancement layer disposed between opposing accessory parts. A second nano-emissive thermal enhancement layer 18 may be disposed on a crematory accessory 34, such as a metal tray or floor, at least partially thereon, thereunder, or in a layer between two layers of the crematory accessory 34, as shown in FIG. 7.

Figure 8:
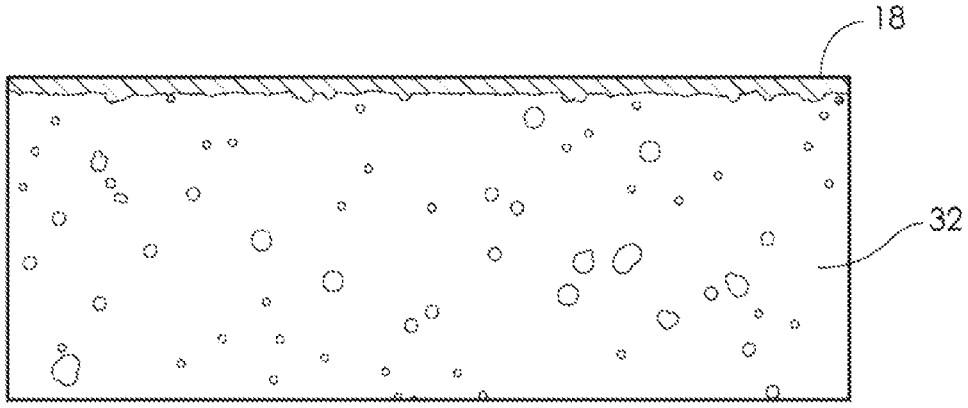
FIG. 8 shows a side view of a refractory material 32 having a nano-emmissive thermal enhancement layer disposed thereon demonstrating the thinness of the layer 18 and the uneven nature of the refractory material 32.
Figure 9:
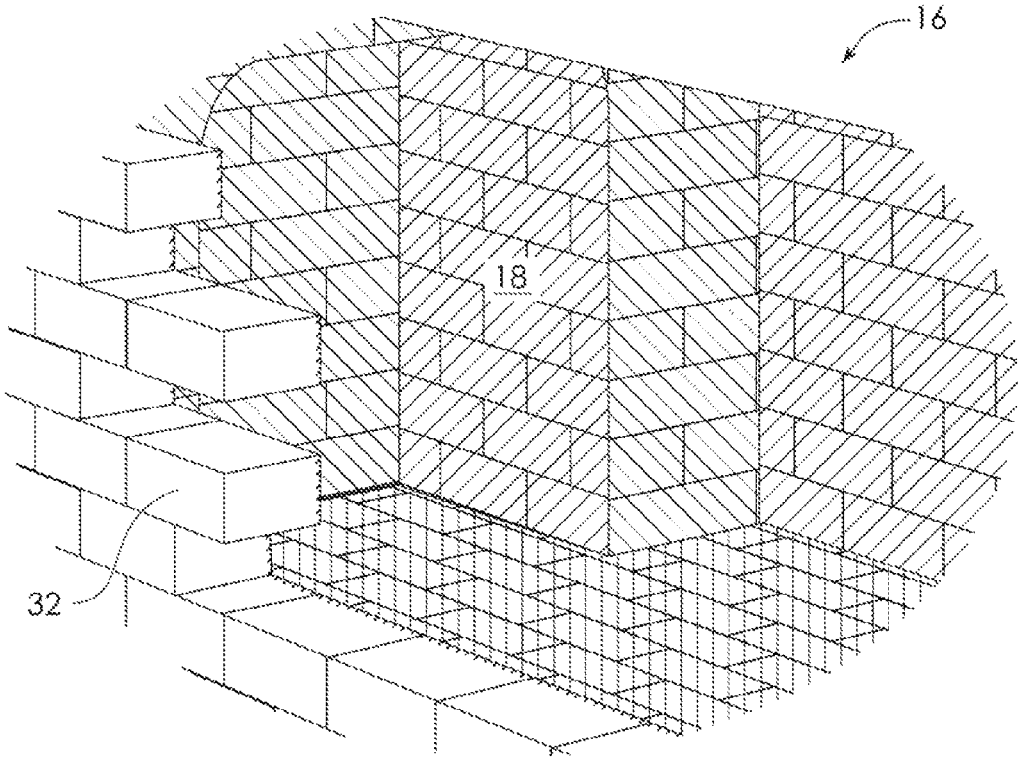
FIG. 9 shows a cutaway side view of an afterburner chamber through which exhaust from the combustion travels to cool down prior to entering smoke stack.

FIG. 8 shows a side view of a refractory material 32 having a nano-emissive thermal enhancement layer disposed thereon demonstrating the thinness of the layer 18 and the uneven nature of the refractory material 32. FIG. 9 shows a cutaway side view of an afterburner chamber through which exhaust from the combustion travels to cool down prior to entering a smoke stack 20 (shown in FIG. 1).

Desirable nano-emissive thermal enhancement coatings and layers are disclosed in U.S. Pat. Nos. 6,921,431, 5,296,288, and 7,105,047, the contents of which are incorporated herein by reference in their entirety. For a ceramic substrate, the layer comprises from about 5% to about 60% of colloidal silica, colloidal alumina, or combinations thereof; from about 23% to about 79% of a filler; and from about 1% to about 20% of one or more emissivity agents. For metal substrates, the layer comprises from about 5% to about 40% of an inorganic adhesive, from about 45% to about 92% of a filler, and from about 1% to about 25% of one or more emissivity agents. Also, for metal substrates, the inorganic adhesive may be taken from the group consisting of an alkali/alkaline earth metal silicate taken from the group consisting of sodium silicate, potassium silicate, calcium silicate, and magnesium silicate.

The emissivity agents may be from about 1% to about 25%, with 1% to about 20% of a first emissivity agent taken from the group consisting of, boron carbide, silicon carbide powder, silicon tetraboride, molybdenum disilicide, tungsten disilicide, zirconium diboride, cupric chromite, and metal oxides. Additionally, from about 0.5% to about 3.5% of a second emissivity agent taken from the grouped consisting of silicon hexaboride. Additionally, from about 1.0% to about 5.0% of a stabilizer may be taken from the group consisting of bentonite, kaolin, magnesium alumina silica clay, tabular alumina, and stabilized zirconium oxide. Additionally, up to about 1.0% of a surfactant, and optionally a colorant, may be included. The optional filler is taken from the group consisting of silicon dioxide, aluminum oxide, titanium dioxide, magnesium oxide, calcium oxide, and boron oxide. The one or more emissivity agents are taken from the group consisting of boron carbide, silicon tetraboride, silicon hexaboride, silicon carbide, molybdenum disilicide, tungsten disilicide, zirconium diboride, cupric chromite, and metallic oxides. The metal oxide emissivity agents are taken from the group consisting of iron oxide, magnesium oxide, manganese oxide, chromium oxide, and derivatives thereof.

If the substrate is ceramic, or of composed of a silicate material, such as the refractory materials 32 including refractory brick 33, a nano-emissive thermal enhancement layer 18 comprises from about 5% to about 35% of colloidal silica, colloidal alumina, or combinations thereof, from about 23% to about 79% of at least one filler, and from about 1% to about 25% of one or more emissivity agents. Alternatively, the nano-emissive thermal enhancement layer on the ceramic substrate has from about 5% to about 35% of colloidal silica, colloidal alumina, or combinations thereof; from about 23% to about 79% of at least one filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides.

A nano-emissive thermal enhancement layer for use on the metal floor, or metal accessories, may have from about 5% to about 30% of an inorganic adhesive, from about 45% to about 92% of at least one filler, and from about 1% to about 25% of one or more emissivity agents. In which, the inorganic adhesive is taken from the group consisting of an alkali/alkaline earth metal silicate taken from the group consisting of sodium silicate, potassium silicate, calcium silicate, and magnesium silicate. The filler is taken from the group consisting of silicon dioxide, aluminum oxide, titanium dioxide, magnesium oxide, calcium oxide, and boron oxide. The one or more emissivity agents are taken from the group consisting of silicon hexaboride, boron carbide, silicon tetraboride, silicon carbide, molybdenum disilicide, tungsten disilicide, zirconium diboride, cupric chromite, and metallic oxides; or combinations thereof.

Alternatively, the high emissivity layer comprises from about 5% to about 30% of an inorganic adhesive, the inorganic adhesive is taken from the group consisting of an alkali/alkaline earth metal silicate taken from the group consisting of sodium silicate, potassium silicate, calcium silicate, magnesium silicate, and polysilicate; from about 45% to about 92% of at least one filler, the filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides.

The anhydrous nano-emissive thermal enhancement coating is initially applied with the compositions suspended in water allowing the use of paint spray apparatuses. The method of making the present crematory design involves spraying a nano-emissive thermal enhancement coating on exposed surfaces, or during construction, sprayed on hidden surfaces opposite the exposed surfaces. The method of making accessories involves spraying them with the coating or spraying a support layer with the coating. If the crematory is a modified crematory, then the exposed surfaces are cleaned and then sprayed with a nano-emissive thermal enhancement coating. Metal adhesive nano-emissive thermal enhancement layer coatings may be applied directly to the metal surfaces, and ceramic a nano-emissive thermal enhancement layer coatings may be applied directly to the ceramic or refractory surfaces.

This method of improving the burn time, energy usage and life of the refractory in a crematory, comprises providing a crematory substrate composed of either a refractory material or a metal accessory, mixing a coating containing a). from about 6% to about 40% of an inorganic adhesive, from about 23% to about 56% of a filler, from about 0.5% to about 15% of one or more emissivity agents, and from about 18% to about 50% water, or b). from about 15% to about 60% of colloidal silica, colloidal alumina, or combinations thereof; from about 23% to about 55% of a filler, from about 0.5% to about 15% of one or more emissivity agents, and from about 10% to 50% water; and applying the coating to the crematory substrate using a spray gun, vaccum deposition, paint brush or dipping the substrate in the mixed composition to form a nano-emissivity enhancement layer from about 1 mils (2.5 microns) to about 10 mils (254 microns) thick to form a nano-emissive thermal enhancement layer.

The coating used to form the nano-emissive thermal enhancement layer may further comprises from about 0.5 percent to about 2.4 percent of a stabilizer; up to about 1.0% of a surfactant; from about 0.5 percent to about 2.4 percent of a stabilizer taken from the group consisting of bentonite, kaolin, magnesium alumina silica clay, tabular alumina, and stabilized zirconium oxide; or a colorant.

The inorganic adhesive may be taken from the group consisting of an alkali/alkaline earth metal silicate taken from the group consisting of sodium silicate, potassium silicate, calcium silicate, and magnesium silicate. The filler is taken from the group consisting of silicon dioxide, aluminum oxide, titanium dioxide, magnesium oxide, calcium oxide, and boron oxide. One or more emissivity agents are taken from the group consisting of boron carbide, silicon tetraboride, silicon hexaboride, silicon carbide, molybdenum disilicide, tungsten disilicide, zirconium diboride, cupric chromite, and metallic oxides. The metal oxides are taken from the group consisting of iron oxide, magnesium oxide, manganese oxide, chromium oxide, and derivatives thereof.

If a spray gun is used, it may be taken from the group consisting of an high volume low pressure spray gun or an airless spray gun. Additional steps may include agitating the solution of thermal protective coating prior to applying, rotating the direction of spray to facilitate an even thickness, preparing the exposed surface first by cleaning or grit blasting, allowing the thermal protective layer (18) to air dry from about two to about four hours, and/or applying the mixed thermal protective coating to the exposed interior surface (17) using a spray gun to form a thermal protective layer (18) from about 1 mils (0.5 microns) to about 10 mils (254 microns) thick.

An example of an embodiment of the present design involves coating a three year old Super Power-Pak III walls made of refractory brick and crown, and the afterburner chamber with a nano-emissive thermal enhancement coating for ceramic surfaces. No coating was applied to the hearth 22. The operating temperature was 1850° F. A significant decrease in cremation time per body was reported. On average, the cremation takes thirty (30°) percent less time than in uncoated crematories. The improved crematory may be operated at 1850° F. utilizing low fire only in a natural gas fired crematory which is a significant improvement over identically situated uncoated crematories. The crematories were run six (6) days a week for twelve (12) hours per day over a sixty (60) day period of time.

It is to be understood that the present invention is not limited to the embodiments described above, but encompasses any and all embodiments within the scope of the following claims.

What is claimed is:

1. A crematory 12 consisting of a main crematory chamber 14 with a loading door 15 to load human remains into the main crematory chamber 14 which is heated by a hearth 22 that generates and maintains sufficiently elevated temperatures to cremate human remains placed within the main crematory chamber 14, the crematory 12 comprising:

crematory walls 25 and 27, including two opposing side walls 25, and a back wall 27 disposed opposite the door 15;

the two opposing side walls 25 be a length to accommodate human remains;

the back wall 27 and opposing door 15 being of sufficient width to accommodate human remains;

a crown 24 disposed at the top of the walls 25 and 27 above a cremation chamber floor 34, the cremation chamber floor 34 being disposed beneath the crown 24 with sufficient height to accommodate human remains therebetween;

the crematory walls 25 and 27 and crown 24 being at least partially composed of refractory material 32 forming a refractory surface 26 or 28;

a nano-emissive thermal enhancement layer 18 selectively disposed at least partially on a refractory surface within the main crematory chamber 14 to modulate the thermal hue therein;

the nano-emissive thermal enhancement layer 18 comprising from about 5% to about 60% of colloidal silica, colloidal alumina, or combinations thereof; from about 23% to about 79% of a filler; and from about 1% to about 25% of one or more emissivity agents.

2. The crematory 12 of claim 1, further comprising:

an after burner chamber 16 for evacuation of exhaust from cremation in which the after burner chamber 16 has a high emissivity thermal enhancement layer disposed at least partially on refractory surfaces therein.

3. The crematory of claim 1, wherein:

the floor further comprises a nano-emissive thermal enhancement layer disposed at least partially thereon, thereunder, or in a layer between two layers of floor.

4. The crematory of claim 1, further comprising:

a second nano-emissive thermal enhancement layer 18 disposed on the floor 34 at least partially thereon, thereunder, or in a layer between two layers of floor in which the second nano-emissive thermal enhancement layer 18 comprises from about 5% to about 40% of an inorganic adhesive, from about 45% to about 92% of a filler, and from about 1% to about 25% of one or more emissivity agents.

5. The crematory 12 of claim 4, further comprises:

from about 1% to about 20% of a first emissivity agent taken from the group consisting of, boron carbide, silicon carbide powder, silicon tetraboride, molybdenum disilicide, tungsten disilicide, zirconium diboride, cupric chromite, and metal oxides; and from about 0.5% to about 3.5% of a second emissivity agent taken from the grouped consisting of silicon hexaboride;

from about 1.0% to about 5.0% of a stabilizer taken from the group consisting of bentonite, kaolin, magnesium alumina silica clay, tabular alumina, and stabilized zirconium oxide;

up to about 1.0% of a surfactant;

a colorant; or combinations thereof.

6. The crematory 12 of claim 4, wherein:

the inorganic adhesive is taken from the group consisting of an alkali/alkaline earth metal silicate taken from the group consisting of sodium silicate, potassium silicate, calcium silicate, and magnesium silicate;

the filler is taken from the group consisting of silicon dioxide, aluminum oxide, titanium dioxide, magnesium oxide, calcium oxide, and boron oxide;

the one or more emissivity agents are taken from the group consisting of boron carbide, silicon tetraboride, silicon hexaboride, silicon carbide, molybdenum disilicide, tungsten disilicide, zirconium diboride, cupric chromite, and metallic oxides;

the emissivity agents are a metal oxide taken from the group consisting of iron oxide, magnesium oxide, manganese oxide, chromium oxide, and derivatives thereof; or combinations thereof.

7. The crematory 12 of claim 4, wherein from about 5% to about 40% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 20% of one or more emissivity agents taken from the group consisting of boron carbide, silicon tetraboride, silicon hexaboride, silicon carbide, molybdenum disilicide, tungsten disilicide, zirconium diboride, cupric chromite, and metallic oxides; or from about 5% to about 40% of an inorganic adhesive, the inorganic adhesive taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 20% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides; and from about 1% to about 5% of a stabilizer taken from the group consisting of bentonite, kaolin, magnesium alumina silica clay, tabular alumina, and stabilized zirconium oxide.

8. The crematory 12 of claim 1, wherein:

the nano-emissive thermal enhancement layer 18 further comprises from about 1% to about 20% of a first emissivity agent taken from the group consisting of, boron carbide, silicon carbide powder, silicon tetraboride, molybdenum disilicide, tungsten disilicide, zirconium diboride, cupric chromite, and metal oxides; and from about 0.5% to about 3.5% of a second emissivity agent taken from the group consisting of silicon hexaboride;

from about 1.0% to about 5.0% of a stabilizer taken from the group consisting of bentonite, kaolin, magnesium alumina silica clay, tabular alumina, and stabilized zirconium oxide;

up to about 1.0% of a surfactant;

a colorant; or combinations thereof.

9. The crematory 12 of claim 1, wherein:

the filler is taken from the group consisting of silicon dioxide, aluminum oxide, titanium dioxide, magnesium oxide, calcium oxide, and boron oxide;

the one or more emissivity agents are taken from the group consisting of boron carbide, silicon tetraboride, silicon hexaboride, silicon carbide, molybdenum disilicide, tungsten disilicide, zirconium diboride, cupric chromite, and metallic oxides;

the emissivity agents are a metal oxide taken from the group consisting of iron oxide, magnesium oxide, manganese oxide, chromium oxide, and derivatives thereof; or combinations thereof.

10. The crematory 12 of claim 1, wherein from about 5% to about 60% of colloidal silica, colloidal alumina, or combinations thereof; from about 23% to about 79% of a filler taken from the group consisting of silicon dioxide, aluminum oxide, titanium dioxide, magnesium oxide, calcium oxide, and boron oxide;

and from about 1% to about 20% of one or more emissivity agents taken from the group consisting of boron carbide, silicon tetraboride, silicon hexaboride, silicon carbide, molybdenum disilicide, tungsten disilicide, zirconium diboride, cupric chromite, and metallic oxides; or from about 5% to about 60% of colloidal silica, colloidal alumina, or combinations thereof; from about 23% to about 79% of a filler taken from the group consisting of silicon dioxide, aluminum oxide, titanium dioxide, magnesium oxide, calcium oxide, and boron oxide; and from about 1% to about 20% of one or more emissivity agents taken from the group consisting of boron carbide, silicon tetraboride, silicon hexaboride, silicon carbide, molybdenum disilicide, tungsten disilicide, zirconium diboride, cupric chromite, and metallic oxides; and from about 1% to about 5.0% of a stabilizer taken from the group consisting of bentonite, kaolin, magnesium alumina silica clay, tabular alumina, and stabilized zirconium oxide.

* * * * *